US005608952A

United States Patent [19]

Wilder

[11] Patent Number: 5,608,952

[45] Date of Patent: Mar. 11, 1997

[54] END CONNECTOR FOR A SLIDE FASTENER

[76] Inventor: Andrew Wilder, Amawalk Rd., Katonah, N.Y. 10536

[21] Appl. No.: 496,576

[22] Filed: Jun. 29, 1995

[51] Int. Cl.[6] ..... A44B 19/40

[52] U.S. Cl. ..... 24/433

[58] Field of Search ..... 24/433–435, 436, 24/388

[56] References Cited

U.S. PATENT DOCUMENTS

| | | | |
|---|---|---|---|
| 2,358,178 | 9/1944 | Marinsky et al. | 24/433 |
| 2,358,179 | 9/1944 | Marinsky | 24/433 |
| 2,395,677 | 2/1946 | Marinsky | 24/433 |
| 4,078,279 | 3/1978 | Heimberger et al. . | |
| 4,139,927 | 2/1979 | Heimberger et al. . | |
| 5,007,145 | 4/1991 | Kim . | |
| 5,272,793 | 12/1993 | Wilk . | |

FOREIGN PATENT DOCUMENTS

| | | | |
|---|---|---|---|
| 612957 | 5/1935 | Germany | 24/435 |
| 941361 | 4/1956 | Germany | 24/433 |

*Primary Examiner*—James R. Brittain
*Attorney, Agent, or Firm*—Natter & Natter

[57] ABSTRACT

An end connector for a zipper slide fastener includes a resilient socket member and a locking blade adapted for lateral snap-fit coupling. The locking blade is longitudinally slidable with respect to the socket member for decoupling. Additionally, a guide blade is simultaneously registrable with a slider member during the coupling operation for aligning the slider member to effect meshing engagement with two rows of complementary zipper teeth. In an alternate embodiment the socket member and locking blade are disposed in angular correspondence and the locking blade is laterally withdrawable from the socket member for decoupling.

9 Claims, 3 Drawing Sheets

END CONNECTOR FOR A SLIDE FASTENER

BACKGROUND OF THE INVENTION

1. Field of the Invention

This invention relates generally to slide fasteners and especially to a zipper closure.

In particular, the device of this invention concerns an end connector for attaching two rows of complementary zipper teeth.

2. Background Art

In conventional zipper slide fasteners as applied to clothing or similar items, the starting ends of juxtaposed rows of zipper teeth must be coupled before a slider member can cause the zipper teeth to mesh. In order to accomplish the end coupling, it is necessary to hold a socket on the end of one row of zipper teeth and to thread a terminal pin on a free end of the other row of zipper teeth through the slider member and into the socket. If the terminal pin on the free end is not fully inserted in the socket, the slider will not properly mate with the zipper teeth. Furthermore, if the free end is not held firmly in the socket, the forward movement of the slider is likely to pull the inserted terminal pin out of the socket thus preventing the correct alignment and meshing engagement of the teeth.

The above operations require some degree of dexterity and can present problems for persons having disabilities, e.g. arthritis in the joints of the fingers or vision loss. These and similar physical impairments make it difficult to thread the terminal pin through the slider member and into the socket. Similar difficulties can occur with young children who may not have the necessary hand-eye coordination for connecting the starting ends of a zipper closure found on many items of childrens' clothing.

Previous attempts to overcome these shortcomings include the end-locking device of U.S. Pat. No. 5,007,145. The device of that patent requires a rather complex hand manipulation wherein a terminal pin of one row of teeth is placed through a port in a slider member and into a mouth of a socket on the other row of teeth.

U.S. Pat. No. 4,139,927 discloses an endstop arrangement that requires the registration of a pin within a socket for press fit engagement and further includes a swingable movement for aligning the respective rows of teeth. A further shortcoming of that device is that the lower portion of the teeth of one row does not mesh with the teeth of the corresponding row to provide a secure closure and neat appearance. A similar deficiency is present in the device shown in U.S. Pat. No. 5,272,793 wherein the snap-lock engagement utilizes a spacer bar which provides an opening at a lower end of the rows of teeth.

An endstop construction as shown in U.S. Pat. No. 4,078,279 utilizes a hook and a hinge pin. This arrangement does not simplify the coupling procedure or provide the ease of use or advantages as in the present invention.

BRIEF SUMMARY OF THE INVENTION

The end connector of this invention involves a simplified coupling arrangement for attaching the ends of opposed interlocking edge surfaces, such as two rows of complementary zipper teeth, and alternately for detaching the respective edge surfaces.

A socket member having a receiving slot, is disposed at a starting end of one row of zipper teeth and a locking blade is disposed at a corresponding end of a second row of zipper teeth. The locking blade is adapted for lateral or sidewise snap-fit seating within the receiving slot for coupling the ends of the respective zipper rows. A guide member adjacent the locking blade is simultaneously insertable within a slider member for aligning the slider member with the second row of zipper teeth.

The locking blade is withdrawn from the socket member by firmly holding the socket member and by applying an upwardly directed force to the locking blade causing the locking blade to slip longitudinally through the slider member.

In an alternate embodiment the locking blade is releasable from the socket by the application of a transversely directed separation force which urgingly expands the receiving slot for withdrawal of the locking blade.

A feature of this invention is that the lateral docking arrangement facilitates registration of the locking blade within the receiving slot without the need for threading the locking blade through the slider member.

Another advantage of the end connector of this invention is that the slider member is automatically aligned with the zipper rows when the locking blade is seated within the socket member.

A further benefit of the end connector of this invention is that the lowermost end of the zipper teeth meshingly engage without any gaps to present a neat appearance.

In view of the foregoing, it should be apparent that the present invention overcomes many of the shortcomings and deficiencies of the prior art and provides an improved end connector for a slide fastener.

Having thus summarized the invention, it will be seen that it is a preferred object thereof to provide an end connector for a slide fastener which is not subject to the aforementioned disadvantages.

An aspect of this invention is to provide an end connector for a slide fastener utilizing lateral edge coupling.

Another aspect of the present invention is to provide an end connector for a slide fastener which ensures that the juxtaposed ends of the zipper rows are properly aligned and locked prior to forward closure movement of the slider member.

A further aspect of the present invention, is to provide an end connector for a slide fastener wherein the zipper rows located behind the slider member are continuously interlocked to furnish a secure closure.

A still further aspect of the present invention, is to provide an end connector for a slide fastener which facilitates the release of the ends of the respective rows of zipper teeth upon completion of the movement of the slider member for disengaging the zipper rows.

Yet a further aspect of this invention is to provide an end connector for a slide fastener that is practical to use, reliable in operation, attractive in appearance, simple in design and economical to manufacture.

BRIEF DESCRIPTION OF THE DRAWINGS

In the accompanying drawings in which are shown an exemplary and alternate embodiment of the invention.

DETAILED DESCRIPTION OF THE INVENTION

Figure 1:
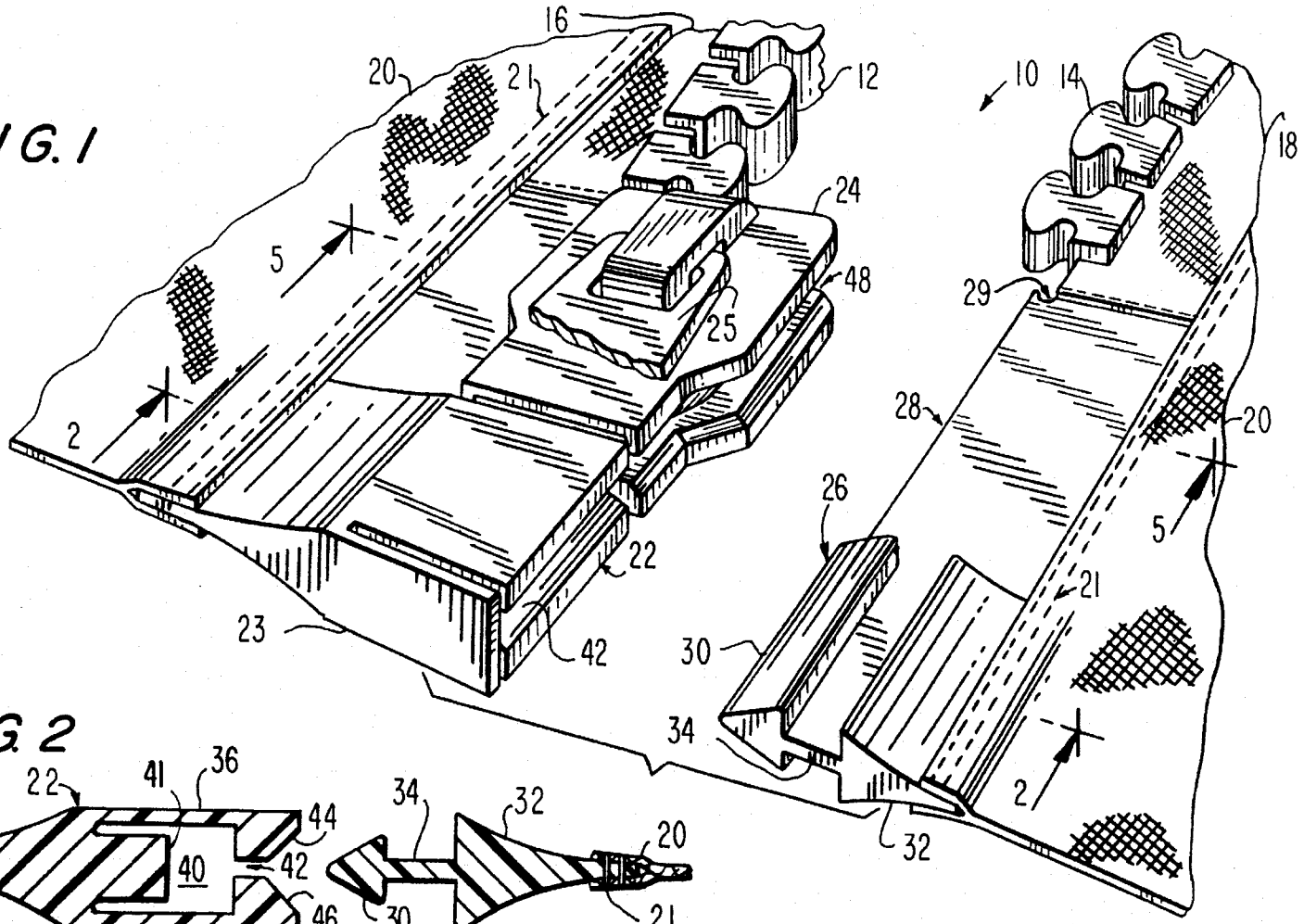
FIG. 1 is a perspective view showing a portion of two respective rows of zipper teeth, a slide member and a socket member disposed at an end of one row of zipper teeth and a locking blade and a guide member disposed at a corresponding end of a second row of zipper teeth.

With specific reference now to the drawings, it is stressed that the particulars shown and described herein are for the purpose of illustrative discussion of the invention and are presented in the course of providing what is believed to be the most useful and readily understood description of the principles and conceptual aspects of this invention. In this regard, no attempt has been made to show the invention in more detail then is necessary for a fundamental understanding however, the description in combination with the drawings should make apparent to those skilled in the art how the invention may be embodied in practice.

Referring now in detail to the drawings, the reference numeral 10 denotes generally an end connector for a slide fastener in accordance with this invention.

The end connector 10 is intended for use with slide fasteners such as zipper closures or other interlocking edge strips, e.g. extruded polymeric strips with one strip having a locking bead and the other strip being provided with a locking groove for receiving the bead. Although the end connector 10 will be discussed with regard to a zipper closure as applied to an article of clothing, it should be understood that the invention encompasses other uses as well.

With regard to the exemplary embodiment, FIG. 1 shows two rows of complementary zipper teeth 12, 14 secured to respective flexible tapes 16, 18 which are attached to a fabric 20 of a garment, e.g. by stitching 21.

A socket member 22 is disposed at a lower or "starting" end of the row of zipper teeth 12 and provides an endstop for a slider member 24 which is displaceable along the row of zipper teeth 12 by use of a pull tab 25. The slider member 24 is further adapted for interlocking the respective rows of zipper teeth 12, 14 in a conventional manner. For this purpose, a locking blade 26 is disposed at a corresponding lower end of the row of zipper teeth 14. Additionally, a guide blade 28, shown as formed integrally with the locking blade 26, will be further discussed hereinafter.

With regard to the locking blade 26, an elongated nose 30 is provided along a leading edge. The nose 30 preferably has a wedge shaped configuration. The opposite edge of the locking blade 26 is provided with a base 32 having a generally triangular configuration. A web 34 is disposed intermediate the nose 30 and the base 32.

The guide blade 28 has a substantially planar configuration and is coextensive with the locking blade 26. A hook 29 or equivalent structure is provided on the guide blade 28 for mating with the lowermost tooth of the row of zipper teeth 12 as is conventional in the art.

Figure 2:
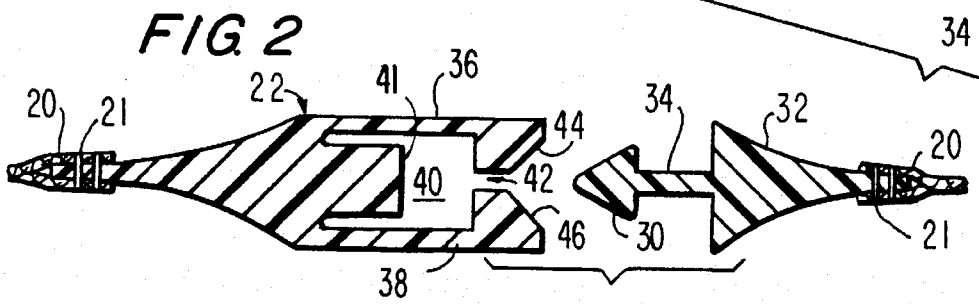
FIG. 2 is a sectional view taken substantially along line 2—2 of FIG. 1 showing an interior chamber, a slot formed in the socket member and a locking blade.

Referring now to the socket member 22 and in particular to FIG. 2; there is shown an upper wing 36 and a lower wing 38 defining a chamber 40 having a rear wall 41. The socket member 22 and the wings 36, 38 are preferably fabricated from thermoplastic materials such as polypropylene, ABS or equivalent compositions having the desired flexural properties. The wings 36, 38 are cantilevered respectively above and below the chamber 40 and are further spaced from an end plate 23 to allow for required deflection. Additionally, the chamber 40 is in communication with a receiving slot 42 having a set of opposed sloped entrance walls 44, 46. The slot 42 extends continuously along a longitudinal edge of the socket member 22 as shown in FIG. 1.

Figure 4:
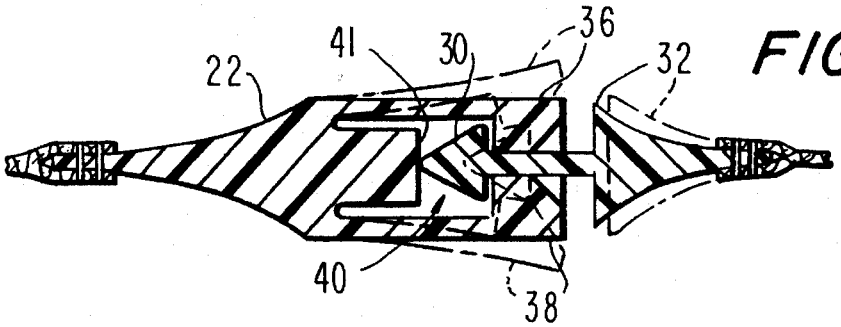
FIG. 4 is a sectional view taken substantially along line 4—4 of FIG. 3 showing the locking blade seated within the socket member and further illustrating in broken-line, displacement of a pair of wing members during entry of the locking blade into the socket member.
Figure 5:
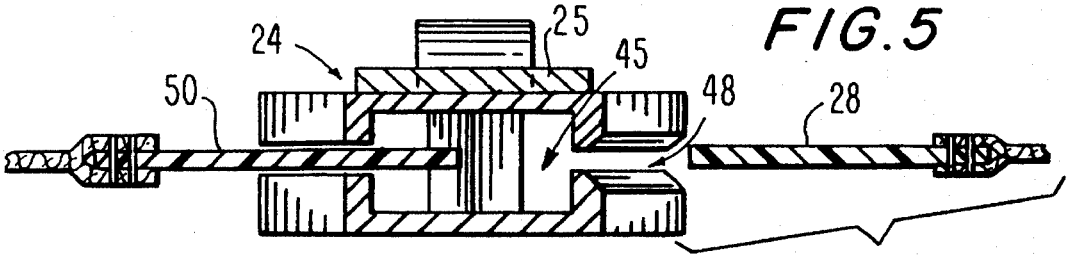
FIG. 5 is a sectional view taken substantially along line 5—5 of FIG. 1 showing the guide member prior to entry into the slider member.

Upon the application of a locking force, the upper and the lower wings 36, 38 are yieldably displaced, as illustrated in FIG. 4 by the broken line, the nose 30 coacts with the sloped entrance walls 44, 46, enters the chamber 40 and is seated therein with the web 34 occupying the slot 42. The rear wall 41 of the chamber 40 provides a limit stop as the nose 30 will abut against the wall 41 when fully seated.

Figure 8:
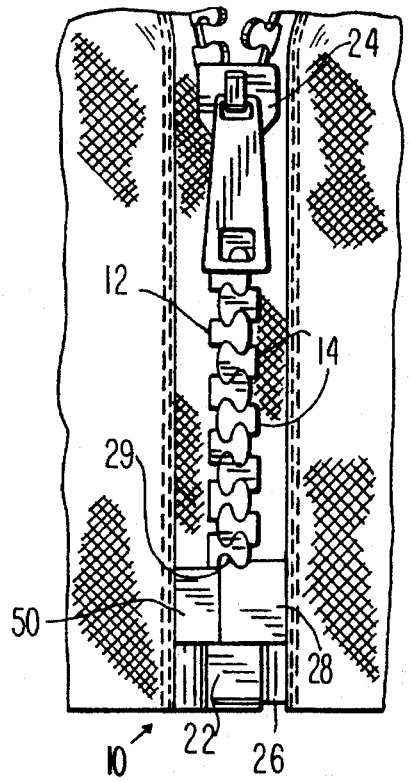
FIG. 8 is substantially a plan view of the end connector showing the respective zipper rows interlocked by the slider member.

It should be noted that simultaneously with this locking engagement, the guide blade 28 is received within a channel 48 of the slider member 24. The channel 48 is coincident with the slot 42. The guide blade 28 is effective for aligning the slider member 24 with the row of zipper teeth 14 for affecting interlocking engagement of the zipper teeth as shown in FIG. 8. The interlocked zipper teeth 12, 14 define a transverse plane that is substantially coincident to the plane of the receiving slot 42 and the locking blade 26.

Figure 6:
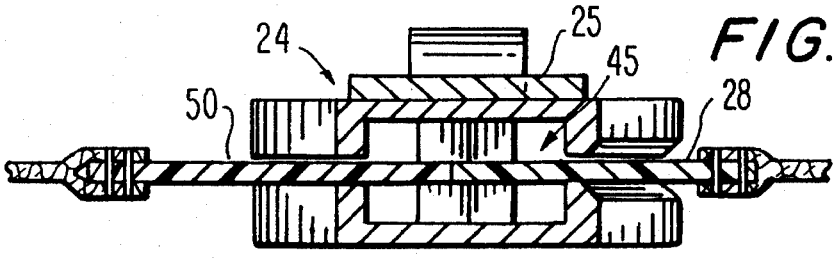
FIG. 6 is a sectional view taken substantially along line 6—6 of FIG. 3 showing the guide member seated within the slider member.
Figure 7:
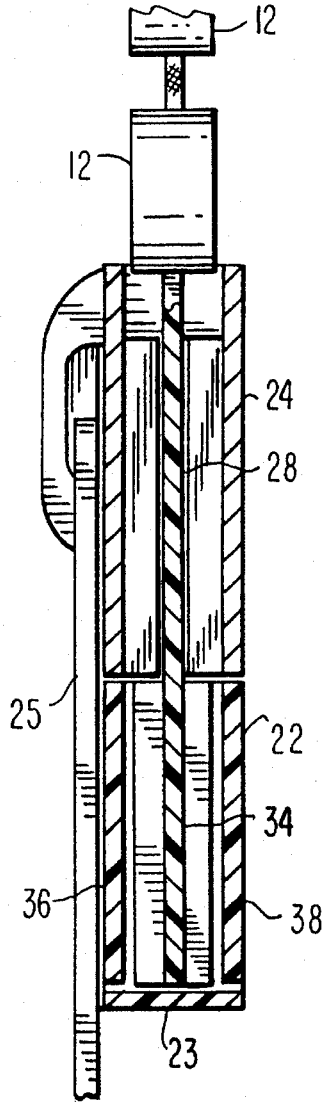
FIG. 7 is an enlarged sectional view taken substantially along line 7—7 of FIG. 3 showing the positioning of the locking blade within the socket member and the guide member within the slider member.

It should be further observed (see FIG. 8) that when the slider member 24 is displaced for locking engagement, the end connector 10 forms a continuous closure with no gaps below the rows zipper teeth 12, 14. For this purpose, a complementary guide stop 50, disposed within the slider member 24, is positioned contiguous to the guide blade 28 as shown in FIG. 6.

Figure 3:
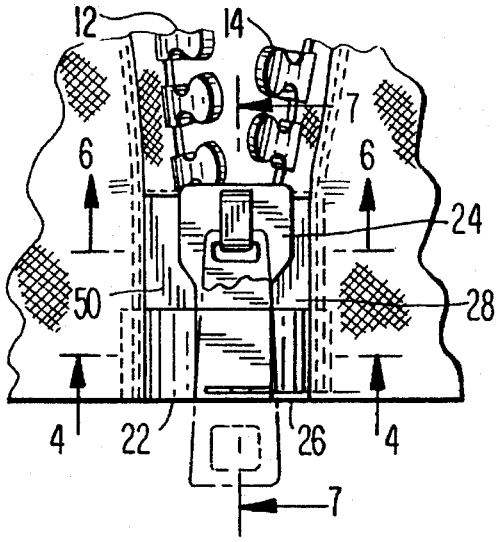
FIG. 3 is substantially a plan view showing the locking blade seated within the socket member and the guide member engaged within the slider member.

When it is desired to disengage the respective rows of zipper teeth 12, 14, as when removing the article of clothing, the slider member 24 is displaced to the lowermost position as shown in FIG. 3 and a longitudinal separation force is applied with respect to the locking blade 26 and socket member 22. The nose 30 and the web 34 are slid from the socket member 22 and through the slider member 24. For this purpose, the slider member 24 has a passage 45 suitable dimensioned for accepting the nose 30 as the web 34 is passed through the channel 48. The above-described coupling and uncoupling operations require a minimum of force and facilitate slide fastener closure and opening especially for garments worn by persons having limited hand-eye coordination.

Figure 9:
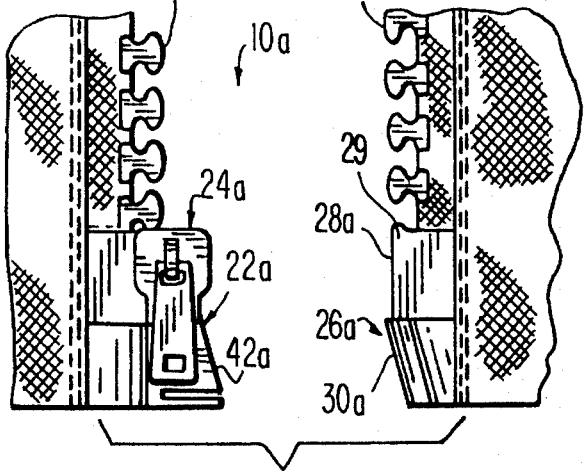
FIG. 9 is a front elevational view of an alternate embodiment showing a locking blade angularly disposed and receivable within an angularly disposed receiving slot of a socket member.
Figure 9A:
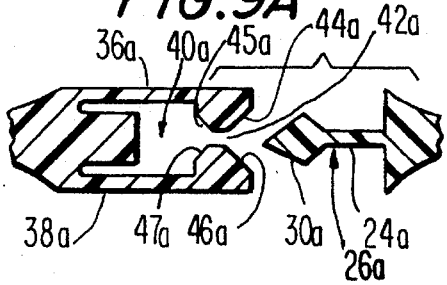
FIG. 9A is a partial sectional view through the socket member and the locking blade of the alternate embodiment of FIG. 9.

In an alternate embodiment, an end connector 10*a* is illustrated in FIG. 9 wherein corresponding reference numerals have been utilized for corresponding components with the addition of the suffix "a". In FIG. 9 there is shown two rows of complementary zipper teeth 12*a*, 14*a*, a slider member 24*a* and a socket member 22*a*. The socket member 22*a* defines a receiving slot 42*a* disposed angularly with respect to a longitudinal axis of the row of zipper teeth 12*a*. A guide blade 28*a* is disposed at a lowermost end of the row of zipper teeth 14*a* and a locking blade 26*a* is provided with a leading edge angularly disposed in correspondence with the slot 42*a*. The locking blade 26*a* includes a nose 30*a* having a double-sided wedge configuration. The uncoupling operation varies from the previous embodiment as will be explained hereinafter. The slot 42*a* has a set of sloped entrance walls 44*a*, 46*a* and a corresponding set of sloped exit walls 45*a*, 47*a* (see FIG. 9A). The nose 30*a* is adapted to coact with the sloped entrance walls 44*a*, 46*a* during the coupling operation, as the locking blade 26*a* enters the chamber 40*a*. The respective wing members 36*a*, 38*a* are simultaneously displaced upon the application of an uncoupling force as the nose portion 30*a* now acts on the sloped walls 45*a*, 47*a* to permit withdrawal of the locking blade 26*a*.

The angular coupling between the socket member 22*a* and the guide blade 26*a* facilitates registration of the nose 30*a* within the slot 42*a*. When viewed from above, as when wearing a jacket having a zipper closure, the location of the slot 42*a* is readily apparent to the person wearing the garment as compared to a conventional slide closure.

In view of the foregoing, it should be seen that there is provided an end connector for a slide fastener which is well adapted to meet conditions of practical use.

It will further be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing descriptions and all changes which come within the meaning and range of equivalency of the claims are therefore intended to be embraced therein.

Having thus described the invention there is claimed as new and desired to be secured by Letters Patent:

1. An end connector for a slide fastener comprising a first and a second opposed interlocking edge surface, a slider member displaceable in one direction along the first edge surface for selective engagement with the second edge surface and for alternate displacement in an opposite direction for disengagement of the edge surfaces, said end connector including coupling means for attaching a lower end of each of the respective edge surfaces, said coupling means including a socket member disposed at the lower end of the first edge surface, said socket member defining a chamber in communication with an entrance slot, a locking blade member disposed at a corresponding lower end of the second edge surface, said locking blade member including a nose element positionable in confronting relationship to the entrance slot and adapted for accessing the entrance slot for snap-fit engagement within the socket chamber, the slider member defining a channel in correspondence with the socket entrance slot, a guide blade member disposed coincidentally to the locking blade member, said guide blade member being receivable within said channel for registering the slider member with the second edge surface simultaneously with the snap-fit coupling of the locking blade member whereby the respective first and second edge surfaces are interlockable by the slider member.

2. An end connector as claimed in claim 1 wherein the entrance slot is defined by at least two wing walls disposed on opposite sides of the socket chamber, with at least one of said wing walls being resiliently deflectable.

3. An end connector as claimed in claim 2 wherein the nose element is adapted for deflecting the wing wall upon application of a laterally directed force for accommodation of the locking blade within the entrance slot.

4. An end connector as claimed in claim 3 wherein a wall of the socket chamber defines a limit stop, said nose element being adapted for abutting contact with said limit stop when the locking blade is seated within the socket chamber.

5. An end connector as claimed in claim 4 wherein the locking blade member defines a base element securable to the second edge surface and a web element interposed between the base element and the nose element.

6. An end connector as claimed in claim 5 wherein the web element is disposed within the entrance slot when the nose element is in abutting contact with the limit stop.

7. An end connector as claimed in claim 3 wherein the nose element is slideable through the socket chamber and the slider member during decoupling.

8. An end connector as claimed in claim 1 wherein the locking blade member is angularly disposed with respect to a longitudinal axis of the second edge surface.

9. An end connector as claimed in claim 8 wherein the entrance slot of the socket member is angularly disposed in correspondence with the locking blade.

* * * * *